United States Patent [19]

Adler

[11] Patent Number: 4,848,315

[45] Date of Patent: Jul. 18, 1989

[54] APPARATUS FOR SUPPLYING HEATED AIR TO AN AIR SYSTEM

[76] Inventor: Lee J. Adler, 2937 Tanager Ave., Los Angeles, Calif. 90040

[21] Appl. No.: 201,953

[22] Filed: Jun. 3, 1988

[51] Int. Cl.[4] ..... F24H 3/00

[52] U.S. Cl. ..... 126/116 R; 126/110 R; 126/110 C; 126/91 R

[58] Field of Search ..... 432/222; 126/110 R, 126/110 C, 116 R, 91 R, 91 A

[56] References Cited

U.S. PATENT DOCUMENTS

| | | | |
|---|---|---|---|
| 2,787,318 | 4/1957 | Wolfersperger | 126/91 A |
| 2,816,714 | 12/1957 | Worley . | |
| 3,018,712 | 1/1962 | Wacker . | |
| 3,160,401 | 12/1964 | Wollner . | |
| 3,728,866 | 4/1973 | Layton . | |
| 3,805,763 | 4/1974 | Cowan | 126/92 R |
| 4,025,292 | 5/1977 | Bailey et al. | 126/91 X |
| 4,340,362 | 7/1982 | Chalupsky et al. . | |
| 4,392,478 | 7/1983 | Black . | |
| 4,396,001 | 8/1983 | Ogino et al. . | |
| 4,448,111 | 5/1984 | Doherty . | |
| 4,525,137 | 6/1985 | Tomioka et al. . | |

FOREIGN PATENT DOCUMENTS

| | | |
|---|---|---|
| 55-146350 | 11/1980 | Japan . |
| 60-1621A | 1/1985 | Japan . |

*Primary Examiner*—Larry Jones

*Attorney, Agent, or Firm*—Harris, Kern, Wallen & Tinsley

[57] ABSTRACT

An apparatus for supplying heated air to an air stream including a first air flow duct having an inlet and an outlet, a blower for forcing air through the duct to the first duct outlet, and a second air flow duct having an inlet, an outlet, and a burner chamber between the inlet and outlet, with the second duct outlet connected to the first duct downstream of the blower for drawing atmospheric air through the second duct by air flow through the first duct. A gas burner in the burner chamber, an apertured refractory wall positioned across the second duct downstream of the burner, and a refractory liner for the inner surface of the burner chamber between the burner means and the apertured wall.

7 Claims, 2 Drawing Sheets

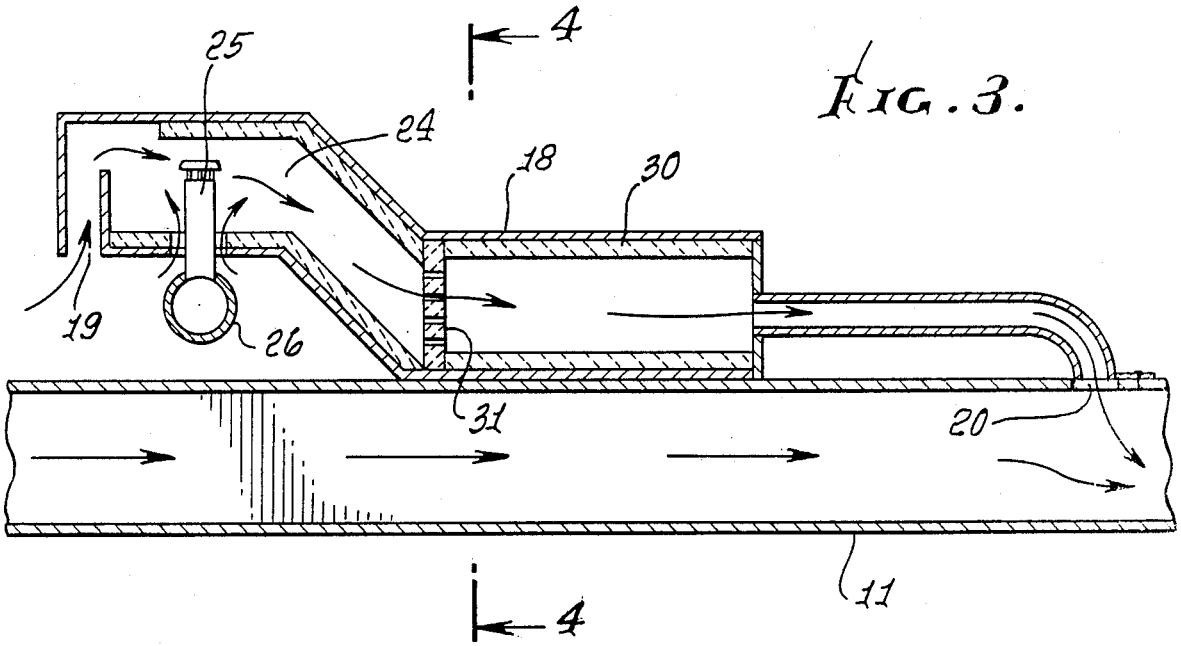
FIG. 3.
FIG. 4.
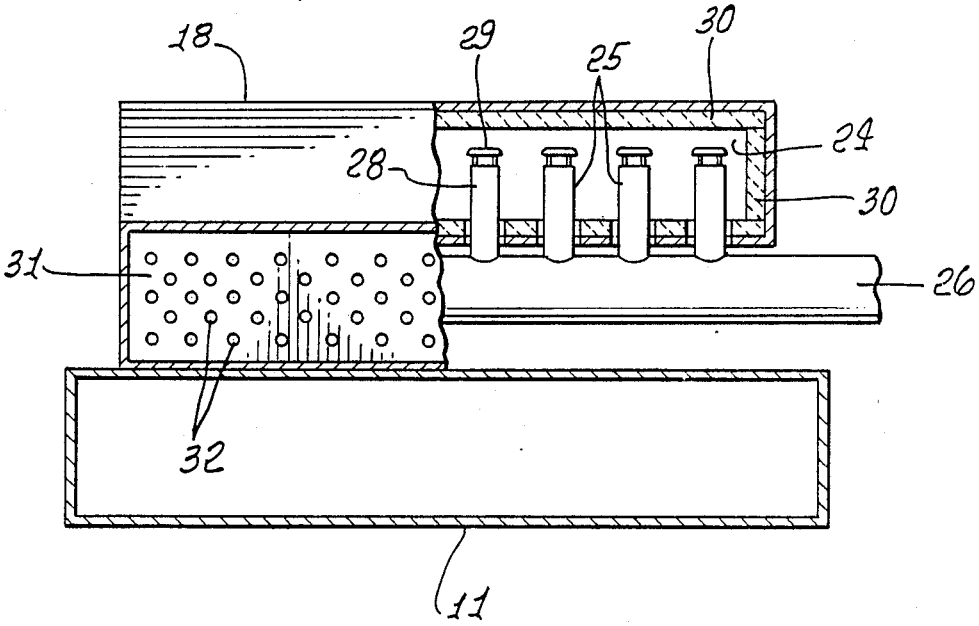

APPARATUS FOR SUPPLYING HEATED AIR TO AN AIR SYSTEM

BACKGROUND OF THE INVENTION

This invention relates to air heating devices and in particular to a new and improved forced air heater.

Typical heated air sources use a gas burner in a combustion chamber for producing heated air, and a blower to move the heated air to the area to be heated. Heating apparatus of this type has been widely used and is very satisfactory in many installations. However these systems also have certain disadvantages. Substantial amounts of air must be moved through the combustion chamber in order to accomplish this, and the blower usually is exposed to the heated air. Also, arrangements of this type do not always make the most efficient use of the energy source.

One use for forced air heat is in the provision of warm air curtains which are used at open doorways and at windows in retail and commercial structures as well as residences. These types of systems are typically installed at the ceiling where space limitations are severe and where the heat of the burner chamber creates problems with adjacent structures and components.

One of the objects of the present invention is to provide a new and improved heated air system wherein the blower or other power source for moving the air can be isolated from the heat source thereby reducing the overall volume of the hot air portion of the system and also reducing the exposure of the blower to hot air.

Another object is to provide such an air heating system having a relatively large volume air supply duct and a blower which moves air therethrough, and a relatively small volume combustion chamber for producing heated air, with the heated air being drawn from the combustion chamber into the main air duct by the moving stream of air in the main air duct. With such an arrangement, a single blower operating with ambient temperature air provides the entire force for moving warm air to the desired location, while permitting a high efficiency, high temperature burner chamber operation.

It is another object of the invention to provide a high efficiency burner chamber consisting essentially of refractory material with an apertured downstream wall of refractory material so that essentially complete combustion is obtained with substantially no unburned fuel in the heated air.

These and other objects, advantages, features and results will more fully appear in the course of the following description.

SUMMARY OF THE INVENTION

An apparatus for supplying heated air to an air stream with a first air flow duct, a blower for forcing air through the duct, a second air flow duct having its outlet opening into the first duct, and a burner chamber in the second duct, with the air flow through the first duct serving to draw air into the burner chamber of the second duct and draw the heated air from the burner chamber into the first duct.

A burner chamber for a hot air supply system with the interior of the chamber lined with a refractory material with one or more burners in the burner chamber and a transverse member positioned downstream from the burners, with this transverse member formed of an aperture refractory material. The outlet duct from the burner chamber may also be lined with the refractory material.

In the preferred embodiment, the burner chamber is a relatively flat configuration adapted for attaching to the main air duct, with a plurality of aligned burners positioned within the chamber and fed from a manifold, preferably with each of the burners comprising a tube and spaced cap of refractory material.

BRIEF DESCRIPTION OF THE DRAWINGS

FIG. 3 is an enlarged partial sectional view taken along the line 3—3 of FIG. 2; and FIG. 4 is a sectional view taken along the line 4—4 of FIG. 3.

DESCRIPTION OF THE PREFERRED EMBODIMENT

Figure 1:
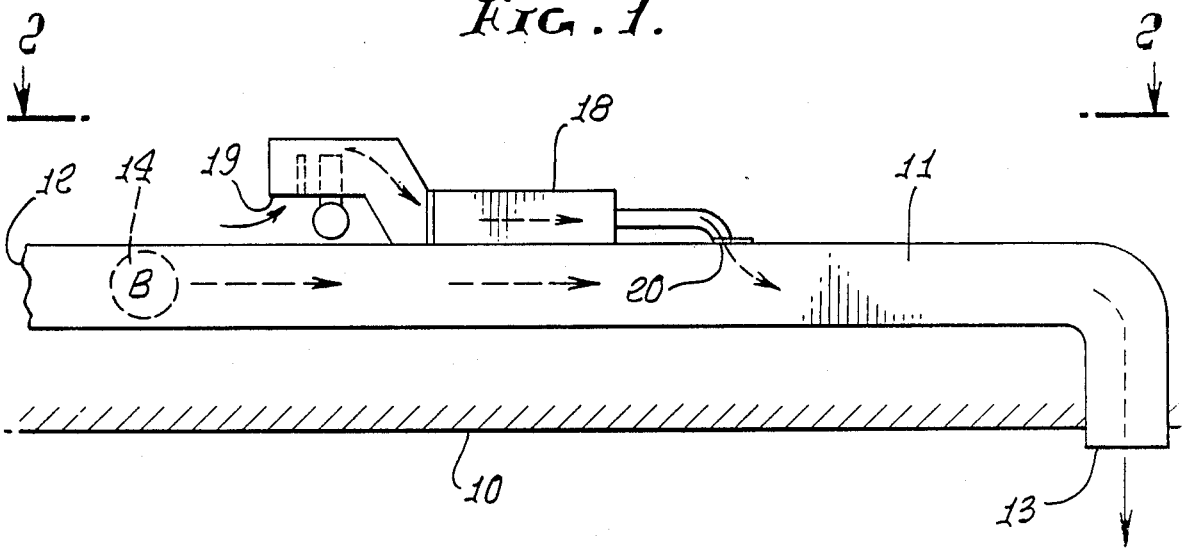
FIG. 1 is a side view of an air heating device incorporating the presently preferred embodiment of the invention.
Figure 2:
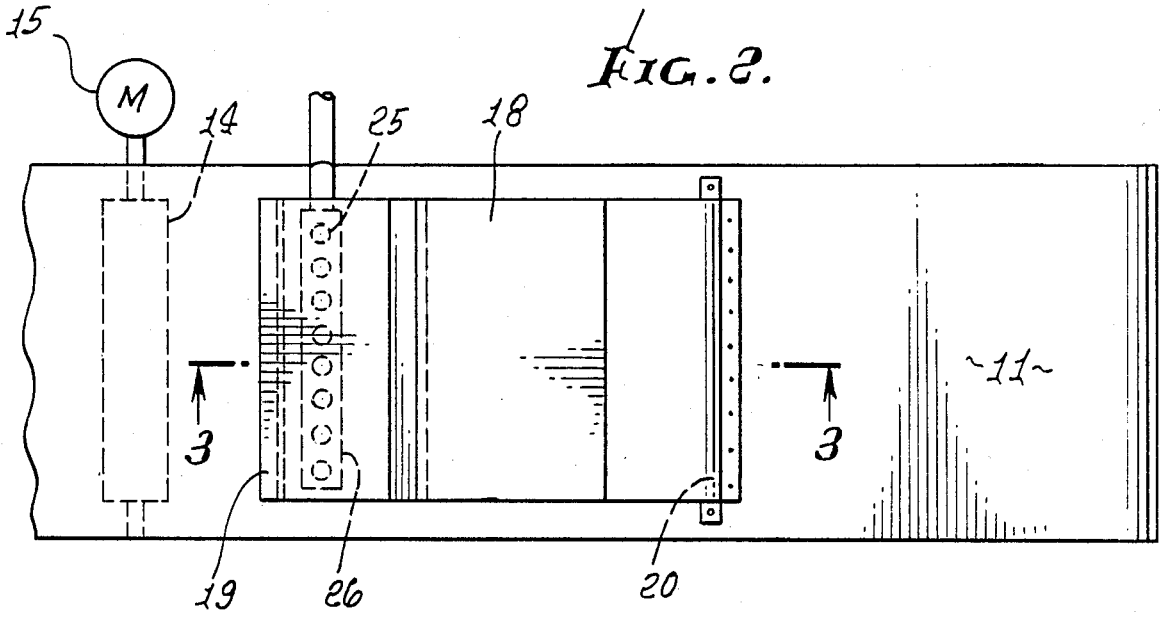
FIG. 2 is a top view taken along the line 2—2 of FIG. 1.

FIGS. 1 and 2 illustrate a typical installation of an air heating device in the space above a ceiling 10. The apparatus includes a main duct 11 with an inlet 12, an outlet 13, and a blower 14 powered by a motor 15.

A second duct 18 with an inlet 19 and an outlet 20 is positioned adjacent the main duct 11. Duct 18 opens into the duct 11 at the outlet 20. The inlet 12 of the main duct 11 and the blower 14 may be located at any convenient position upstream of the second duct outlet 20, preferably with the blower and motor well spaced from the second duct 18. A drum blower 14 and electric motor 15 are illustrated diagramatically, but any mechanism for moving air through the duct 11 may be utilized.

As best seen in FIGS. 3 and 4, a burner or combustion chamber 24 in the duct 18 has a plurality of burners 25 positioned therein, with the burners fed from a manifold 26. Each burner preferably consists of a tube 28 with a cap 29 supported on the tube spaced from the open end of the tube. In operation, combustion gas is fed to the burners through the manifold, with combustion air entering the combustion chamber at the inlet 19 and also preferably around each of the burner tubes where the burner tube projects into the combustion chamber. The plurality of aligned burner tubes is the presently preferred arrangement for the burner in the combustion chamber, but it is recognized that other types of burners can be utilized as desired.

In the preferred embodiment illustrated, all or most of the inner surface of the burner chamber is lined with a refractory material 30, typically a ceramic tile such as Fiberfrax. A transverse member 31, also a refractory material, is positioned across the duct 18 downstream of the burners 25, with the member 31 having a plurality of apertures 32 therethrough. Also, the inner surface of the duct 18 downstream of the transverse member 31 may be lined with the refractory material 30.

The ducts 11 and 18 may have various cross section shapes, sometimes depending upon the area to be heated and the space in which the apparatus can be installed. However in the preferred embodiment illustrated, the ducts are rectangular, and many times wider than high, as seen in FIG. 4. In a typical installation for providing an air curtain at a doorway, the main duct 11 may be 36 inches wide and four inches high, with the second duct 18 in the combustion chamber being 30 inches wide and four inches high.

In operation, air is moved through the main duct 11 by the blower 14. This motion of air past the second duct outlet 20 draws air into the second duct at the inlet 19, and also in around the burner tubes when openings are provided. Gas combustion occurs in the combustion chamber, with the caps 29 deflecting the combustion gas outward from each tube for improved burning. The air flow induced in the duct 18 by the air flow in the duct 11 causes the combustion flame to be deflected to the right toward the transverse member 31, with most of the combustion taking place between the burner tubes and the transverse member. The apertured transverse member functions to achieve substantially complete combustion of the fuel gas at or immediately downstream of the transverse member, probably due to increased mixing which occurs as the fuel gas and air flow through the apertures 32. With this arrangement, there is substantially no unburned fuel in the outlet of the duct 18. In a typical installation, the transverse member 31 is about 5/16 inch thick, with openings about 1/32 inch diameter, with the total area of the openings comprising about 50 percent of the surface of the member. The refractory material used as the liner for the combustion chamber may also be about one inch thick.

With the apparatus as described, the hot air from the duct 18 is drawn into the main duct 11 and mixed with the air moving through the main duct, to provide the desired warm air at the main duct outlet 13. While the apparatus is shown in a horizontal configuration above a ceiling in the drawing figures, the apparatus can be operated in any orientation and is not limited to the specific orientation illustrated.

With the construction illustrated, the blower may be located at any position remote from the burner chamber thereby isolating the blower and its drive motor from the heat source. Also, the thermal insulation provided by the refractory material protects the blower and motor. This is an important advantage in many installations, substantially reducing the maintenance and replacement requirements for the blower and blower motor.

In the embodiment illustrated, the flow path in the duct 18 is horizontal past the burners 25, then slopes downward at an oblique angle to the apertured member 31, and is then again horizontal. It appears that this change in flow path upstream of the apertured member improves the burner operation by creating some turbulence and back pressure in the flow, and is the presently preferred embodiment.

When the burner is in operation, the refractory material is heated and becomes red-hot. Also, the burner tubes 28 and caps 29 may be made of the refractory material and also will glow red-hot. Radiation from the heated refractory material further heats the air moving through the duct 18, thereby increasing the efficiency of the burner operation. At the same time, this refractory material provides the desired low temperature at the exterior surface of the duct 18 and also eliminates the problem of bits of metal being introduced into the heated air stream from the walls of the duct. The red-hot refractory material, particularly at the apertured member 31, also serves to aid the desired complete combustion of the fuel gas.

In many localities, the hydrocarbon emission from all types of combustion chambers must meet severe requirements for the amount of nitrogen oxides in the exhaust, usually measured in parts per million of NOx. Applicant's commercial product has met the very strict requirements of the Los Angeles basin, producing less than forty parts per million NOx thereby demonstrating the high combustion efficiency achieved with applicant's design.

Another feature of the apparatus of the invention is that it can be utilized for heating a space while not utilizing air from the space, thereby keeping contaminated air in the space out of the heating air stream. By way of example, the air heating device may be located in a space to be heated while positioning the inlet of the duct 11 and the blower at a remote location so that external air is brought into the space rather than recirculating air in the space.

In the commercial product incorporating the preferred embodiment of the invention, the desired warm air flow at the outlet 13 is achieved with a flow rate of 2500 cubic feet per minute produced by the blower, with an additional flow through the combustion chamber of only 33 cubic feet per minute, with this additional flow being obtained without any separate ducting or blower for the combustion chamber air supply. Under these conditions the burner consumes 200,000 BTU's per hour and produces a 72° F. increase in temperature in the air stream. With an additional flow through the combustion chamber of 39 cubic feet per minute and a burner consumption of 300,000 BTU's per hour, the air stream temperature is raised by 103° F.

I claim:

1. In an apparatus for supplying heated air to an air stream of air to be heated, the combination of:

a first air flow duct having an inlet and an outlet for flow of the air to be heated;

blower means for forcing the air to be heated through said first duct to said first duct outlet;

a second air flow duct separate from said first duct and having an inlet, an outlet, and a burner chamber between said inlet and outlet;

gas burner means in said burner chamber; and an apertured refractory wall positioned across said second duct downstream of said burner means defining said burner chamber between said second duct inlet and said wall;

with said second duct outlet connected to said first duct at a junction downstream of said blower means, downstream of said burner chamber and upstream of said first duct outlet for drawing atmospheric air into said burner chamber through said second duct inlet by blower forced air flow of the air to be heated through said first duct, with gas combustion in said burner chamber producing hot air, and with the hot air and the air to be heated mixing in said first duct downstream of said junction and upstream of said first duct outlet.

2. An apparatus as defined in claim 1 wherein said second duct includes first, second and third sections, with said first and third sections parallel with each other and with said second section disposed obliquely to and interconnecting said first and third sections, and with said apertured refractory wall positioned adjacent the junction of said second and third sections.

3. An apparatus as defined in claim 1 including a refractory liner for the inner surface of said burner chamber between said burner means and said apertured wall.

4. An apparatus as defined in claim 3 wherein said burner means includes a plurality of burner tubes carried on a manifold with a cap spaced from the outer end of each tube, with said tubes and caps of a refractory material.

5. An apparatus as defined in claim 4 with said second duct downstream of said apertured wall mounted on said first duct and with said burner chamber spaced from said first duct.

6. An apparatus as defined in any of claims 1 and 2–5 wherein said first and second ducts are of rectangular cross section with the width several times the height and with said ducts disposed in parallel relation along the widths, and with said burner chamber having a burner position disposed across the width of said burner chamber adjacent said second duct inlet.

7. An apparatus for supplying heated air to an air stream, including in combination:

a burner chamber having top, bottom, and side walls, with an air inlet and an air outlet;

burner means projecting into said burner chamber through one of said walls;

a manifold for providing gas to said burner means;

said burner means comprising a plurality of tubes carried on said manifold, with each of said tubes formed of a refractory material with the interior of said burner chamber lined with a refractory material;

a transverse member disposed across said burner chamber downstream of said burner means, with said member formed of an apertured refractory material;

an air flow duct with an air supply means for moving air to be heated through said duct to a duct outlet; and means for connecting said burner chamber air outlet to said air flow duct at a junction located between said air supply means and said duct outlet, with air flow through said air flow duct drawing atmospheric air into said burner chamber air inlet, past said burner means and said apertured transverse member and through said burner chamber air outlet into said air flow duct at said junction.

* * * * *